United States Patent [19]

Baker et al.

[11] 4,435,253

[45] Mar. 6, 1984

[54] GOLD SULPHITE ELECTROPLATING SOLUTIONS AND METHODS

[75] Inventors: Kenneth D. Baker, Bridgewater; Hans Scheider, Bloomfield, both of N.J.

[73] Assignee: OMI International Corporation, Warren, Mich.

[21] Appl. No.: 461,341

[22] Filed: Jan. 28, 1983

[51] Int. Cl.[3] ..... C25D 3/48; C25D 3/62

[52] U.S. Cl. ..... 204/43 G; 204/46 G

[58] Field of Search ..... 204/43 G, 46 G, 109, 204/123; 106/1.23, 1.26

[56] References Cited

U.S. PATENT DOCUMENTS

| | | | |
|---|---|---|---|
| 3,475,292 | 10/1969 | Shoushanian | 204/44 |
| 3,666,640 | 5/1972 | Smith et al. | 204/44 |
| 3,776,822 | 12/1973 | Baker | 204/46 G |
| 3,980,531 | 9/1976 | Ludwig et al. | 204/43 R |
| 3,990,954 | 11/1976 | Foulke et al. | 204/46 G |
| 4,199,416 | 4/1980 | Middleton et al. | 204/44 |
| 4,253,920 | 3/1981 | Fletcher et al. | 204/43 G |

*Primary Examiner*—G. L. Kaplan

*Attorney, Agent, or Firm*—Richard P. Mueller

[57] ABSTRACT

An electroplating bath solution comprising an alkali metal or ammonium gold sulphite, a water soluble salt of thallium metal to effect brightening and grain refining, and a non-hydroxy, non-amino carboxylic acid such as formic acid and oxalic acid to ensure that the bright gold metal deposit has a hardness lower than about 90 Knoop. The method of depositing the bright gold metal on various substrates from such electroplating solutions is also described and claimed.

19 Claims, No Drawings

GOLD SULPHITE ELECTROPLATING SOLUTIONS AND METHODS

FIELD OF THE INVENTION

The present invention relates to improved electroplating bath solutions for depositing bright gold having hardness values below about 90 Knoop on various substrates.

BACKGROUND OF THE INVENTION

It is known in the art to incorporate metals such as thallium or arsenic into electrolyte solutions for depositing gold from alkali metal gold sulphite complexes from aqueous electroplating solutions. The use of such metal additives is stated to enhance the brightness of the deposit as well as to improve its finish and grain size.

U.S. Pat. No. 3,562,120 describes a gold metal electrolytic process with a bath containing a minor amount of thallium, calculated as metal. The pH of the electrolyte solution was within the range of 3 to 6. A later patent, U.S. Pat. No. 3,644,184, calls for an electrolyte solution which is neutral or alkaline and which contains gold in the form of an alkali metal gold cyanide complex. The pH is disclosed as being at least 6.5 and preferably from about 7 to about 13. A variety of acids may be added to the electroplating solution to achieve the desired pH. These acids include weak organic acids such as formic acid, citric acid, acetic acid, tartaric acid, gluconic acid, and the like. The thallium is added in the form of a water soluble salt such as thallous and thallic salts including the sulfates, nitrates, sulphide, chlorides, fluosilicates, and the like.

In a later patent, U.S. Pat. No. 3,666,640, the novel electroplating bath is prepared from an alkali metal gold sulphite complex. Along with the use of various other additives including certain metal additives, the patentee states that the addition of small amounts of arsenic, antimony or selenium can be utilized to improve the hardness of the gold metal deposit. The use of chelating agents such as disodium EDTA compounds, nitro and amino polycarboxylic acids, and hydroxy organic acids such as citric acid, lactic acid and tartaric acid is also disclosed.

The use of arsenic as an additive in combination with a carboxylic acid in electroplating bath solutions is known from U.S. Pat. No. 3,776,822. In that patent the gold is utilized in the form of an alkali metal gold sulfite complex, and according to the patentee the combination of the foregoing components in the electroplating bath provides gold deposits with controlled hardness values below 130 Knoop. The metals which may be added to the bath include arsenic, antimony, selenium as well as tellurium. These are provided in the form of their soluble salt. The polycarboxylic acids employed by the patentee include succinic, malonic and oxalic acids as well as their derivatives such as maleic acid. The preferred combination of a polycarboxylic acid and "semimetal additive" is oxalic acid and arsenic trioxide, respectively. However, the use of arsenic as an additive has certain disadvantages in that it readily oxidizes from the trivalent state to the pentavalent state at which time its usefulness as a brightener/grain refiner ceases. Furthermore, the control of such electroplating bath solutions is very difficult. Conventional analytical procedures only determine the total arsenic content of the bath and do not distinguish between the active trivalent state and the inactive pentavalent state. Thus, despite the fairly developed state of this art there is still a problem to be solved insofar as it would be desirable to have an easily analyzable system where the alkali metal gold sulphite eletrolyte consistently produces a pure, bright, soft gold deposit.

In summary, gold metal deposits from non-cyanide complexes such as alkali metal gold sulphites tend to be hard, e.g. 140 Knoop, when using either thallium or arsenic salts as brighteners/grain refiners. Without these grain refiners, the gold deposits tend to be powdery and of little use to the electronics industry. Nevertheless, the hardness of the gold deposits with either thallium or arsenic metal additives give deposits having hardnesses unacceptable to the semiconductor industry, which generally requires a gold metal purity of about 99.9% and a hardness value below 90 Knoop.

OBJECTS OF THE INVENTION

One object of the present invention is to provide an improved alkali metal or ammonium gold sulphite electroplating bath solution which avoids the problems encountered with presently available baths.

Another object of the present invention is to provide an aqueous alkali metal or ammonium gold sulphite electroplating solution which contains a specific combination of additives to achieve a gold deposit having the desired purity, brightness and softness.

A further object of the present invention is to provide an alkali metal or ammonium gold sulphite electroplating bath solution which utilizes thallium as the brightener/grain refiner additive while also attaining Knoop hardness values lower than about 90.

A still further object of the present invention is to provide a method for regularly depositing pure, bright, soft gold deposits on various substrates utilizing an alkali metal or ammonium gold sulphite electroplating bath.

These and other objects of the invention will become readily apparent from the ensuing description of the invention.

SUMMARY OF THE INVENTION

In accordance with the present invention it has now been found that an improved alkali metal or ammonium gold sulphite plating bath can be achieved by utilizing thallium as the brightener and grain refiner in combination with a non-hydroxy, non-amino carboxylic acid.

The particular non-hydroxy, non-amino carboxylic acid useful for the present purposes include formic acid, and oxalic acid. It has also been found that numerous acids which have been previously described in the prior art teachings are ineffective for the present purposes. Such acids include citric acid, tartaric acid, lactic acid, gluconic acid, as well as other hydroxy and polyhydroxy carboxylic acids, and amino carboxylic acids such as EDTA and derivatives thereof. In contrast to the arsenic additive used in U.S. Pat. No. 3,776,822; thallium does not readily oxidize in the electroplating bath solution and is easily controllable by simple analysis, for example, atomic absorption spectroscopy. Consequently the electroplating bath solutions of this invention consistently produce gold metal deposits having both the desired appearance, purity and hardness.

Another aspect of the present invention involves the method of effectively electroplating pure, soft, gold metal deposits on a variety of substrates using the specific electrolyte solutions described above wherein the source of the gold metal is an alkali metal or ammonium gold sulphite and two essential additives are thallium and a non-hydroxy, non-amino carboxylic acid.

DETAILED DESCRIPTION OF THE INVENTION

As previously described the essential feature of the present invention is to formulate an alkali metal or ammonium gold sulphite electroplating bath which will consistently produce a pure, bright, soft gold metal deposit on various substrates over a relatively long period of time. The formulation comprises as essential ingredients, an alkali gold metal sulphite, a thallium metal salt, and a non-hydroxy non-amino carboxylic acid. The pH of the bath will range from about 6.0 to 12, and preferably from about 7.5 to 10. Electroplating temperatures will be from about 25° to 80° C. and preferably between about 50° and 65° C.

The monovalent gold component is an alkali metal or ammonium gold sulphite. The alkali metal can be sodium, potassium or lithium.

The thallium metal component is preferably furnished to the bath in the form of water soluble salts such as the nitrate, sulfate, acetate, halide, carbonate, oxide, hyroxide, sulfite, or oxalate. In the electroplating solutions of the present invention the concentration of the thallium metal in the solution will range from about 0.01 to 0.25 grams per liter, and preferably from about 0.01 to 0.10 grams per liter. In general, the amount of gold metal in the bath will range from about 2 to 25.0 grams per liter.

The particular non-hydroxy, non-amino carboxylic acids useful in the present invention are formic and oxalic acids. The amounts of acid employed in formulating the electroplating solutions will range from about 0.20 to 100 and preferably from about 1.0 to 75 grams per liter.

It will be understood that the baths may contain other conventional electroplating additives such as conducting and stability additives. Conducting salts that may be usefully employed include alkali metal or ammonium phosphates, pyrophosphates, sulphate, citrates or borates. On the other hand, stability salts which may be utilized include alkali metal or ammonium sulphites and the like. For most purposes the conducting additive may be used in amounts ranging from about 5 to 100 grams per liter; while the stability additives are used in amounts ranging from about 15 to 50 grams per liter.

Although for most operations the electroplating baths of this invention may be operated at temperatures within the range of 25° to 80° C., and current densities of from about 0.5 to 50 ASF; it will be understood that temperatures, current densities, and treatment times may vary widely depending, of course, upon such factors as the type of substrate employed, the deposit thickness required, etc. The electroplating baths of this invention may be effectively utilized for plating operations both in the electronic field as well as in the decorative field. Illustrative substrates include brass, copper, copper alloys, metallized ceramics, and silicon wafers. As previously discussed, the electroplating baths of this invention are essentially useful in the electronics industry where certain desired grain refinements along with high purity are required in addition to hardness values lower than about 90 Knoop.

It should also be understood that conventional pretreatments, e.g., precleaning, of the substrates prior to being subjected to the plating operations are also contemplated within the scope of the present invention. Thus, for example, a metal substrate such as a brass panel may be subjected to a degreasing step using a hot alkaline solution followed by rinsing with distilled water. The panel may then be dipped in hydrochloric acid or sulfuric acid. Finally, there may be another rinsing treatment with distilled water. Since all of these and other pretreatment or precleaning treatments are well known in the art, the exact procedures employed are not features of the present invention.

The present invention will be more fully understood by reference to the following illustrative embodiments:

EXAMPLE

A series of runs were conducted to determine the hardness values of gold deposits obtained from a thallium-containing alkali metal gold sulphite electroplating bath solution. The exact procedure employed was to add other additives to the thallium component and then to add the resulting admixtures to the alkali metal gold sulphite electrolyte. The formulations of each run as well as the hardness values are shown in the table set forth below where the amounts of the components are expressed in grams per liter unless otherwise indicated:

TABLE

| | BATH 1 | BATH 2 | BATH 3 | BATH 4 | BATH 5 | BATH 6 |
|---|---|---|---|---|---|---|
| COMPONENTS | | | | | | |
| A. Gold as Alkali/metal-sulphite | 8 | 8 | 8 | 8 | 8 | 8 |
| B. Conducting Salt | 50 | 50 | 50 | 50 | 50 | 50 |
| C. Stability Salt | 30 | 30 | 30 | 30 | 30 | 30 |
| D. Thallium, as metal | 0.015 | | | | | |
| E. Thallium/Citric Acid | | 0.015/75 | | | | |
| F. Thallium/EDTA | | | 0.015/25 | | | |
| G. Thallium/Oxalic Acid | | | | 0.015/50 | | |
| H. Thallium/Formic Acid | | | | | 0.015/50 | |
| I. Arsenic/Oxalic Acid | | | | | | 0.015/50 |
| INITIAL DEPOSITS | | | | | | |
| Electrolysis | | | | | | |
| Hardness (Knoop) | 135–140 | 135–140 | 135–140 | 60–80 | 60–80 | 60–80 |
| Color (Lemon Yellow) | Yes | Yes | Yes | Yes | Yes | Yes |
| DEPOSITS AFTER 2 AMPS/HR ELECTROLYSIS | | | | | | |
| Hardness (Knoop) | 135–140 | 135–140 | 135–140 | 60–80 | 60–80 | 60–80 |
| Color (Lemon Yellow) | Yes | Yes | Yes | Yes | Yes | Brown |

The conducting salt was sodium dibasic phosphate and the stability salt was sodium sulphite. Thallium in the form of thallium sulphate was employed in the runs.

All baths were operated at a temperature between 50° and 52° C. as well as at a pH of 9.5.

As shown by the above data, the combinations of thallium with oxalic acid and with formic acid produced the desired hardness of less than 90 Knoop. The gold metal deposits in these runs were also bright, and 99.9% plus pure; thereby having ideal characteristics for die bonding and wire attachment as well as tape automated bonding (TAB) applications. In contrast, the use of thallium alone, thallium plus citric acid, and thallium plus EDTA led to unsatisfactory hardness values for electronic uses.

On the other hand, the use of arsenic in place of thallium in Bath 6 revealed that the desired brightness soon went from lemon yellow to brown, the latter color being indicative of the loss of grain refinement.

Other modifications and variations of the invention will suggest themselves to those skilled in the art in view of the foregoing description. It is to be understood, therefore, that changes may be made in the specific embodiments described without departing from the scope and principles of the present invention, as defined in the appended claims, and without sacrificing its chief advantages.

What is claimed is:

1. In an aqueous electrolyte sulphite gold electroplating solution comprising an alkali metal or ammonium gold sulphite, and at least a grain refining amount of thallium metal, the improvement where said solution also contains a non-hydroxy, non-amino carboxylic acid to maintain the hardness of the gold deposited therefrom below about 90 Knoop.

2. In the electroplating solution of claim 1 wherein the alkali metal gold sulphite is sodium gold sulphite.

3. In the electroplating solution of claim 1 wherein the alkali metal gold sulphite is potassium gold sulphite.

4. In the electroplating bath of claim 1 wherein the alkali metal gold sulphite is lithium gold sulphite.

5. In the electroplating bath of claim 1 wherein the gold sulphite is ammonium gold sulphite.

6. In the electroplating solution of claim 5 wherein the water-soluble salt is thallium sulphate.

7. In the electroplating solution of claim 5 wherein the water-soluble salt is thallium nitrate.

8. In the electroplating solution of claim 1 wherein the thallium metal is present as a water-soluble salt.

9. In the electroplating solution of claim 1 wherein the carboxylic acid is formic acid.

10. In the electroplating solution of claim 1 wherein the carboxylic acid is oxalic acid.

11. A method of electrodepositing gold which comprises electrolyzing at a current density of 0.5 to 50 ASF and a temperature from about 25° to 80° C. an electrolyte having a pH of from about 6 to 12 said electrolyte comprising an alkali metal or ammonium gold sulphite, a soluble thallium salt to attain a thallium metal concentration sufficient to effect brightening and grain refining, and a non-hydroxy, non-amino carboxylic acid in a minor amount sufficient to give a gold deposit with a Knoop hardness below 90.

12. The method of claim 11 wherein the alkali metal gold sulphite is sodium gold sulphite.

13. The method of claim 11 wherein the alkali metal gold sulphite is potassium gold sulphite.

14. The method of claim 11 wherein the alkali metal gold sulphite is lithium gold sulphite.

15. The method of claim 11 wherein the gold sulphite is ammonium sulphite.

16. The method of claim 11 wherein the thallium salt is thallium nitrate.

17. The method of claim 11 wherein the thallium salt is thallium sulphate.

18. The method of claim 11 wherein the carboxylic acid is formic acid.

19. The method of claim 11 wherein the carboxylic acid is oxalic acid.

* * * * *